United States Patent [19]

Baldyrou

[11] Patent Number: 4,983,134

[45] Date of Patent: Jan. 8, 1991

[54] MALE CONTACT ELEMENT FOR LOW INSERTION FORCE ELECTRICAL CONNECTOR

[75] Inventor: Armel Baldyrou, Houilles, France

[73] Assignee: Societe Generale Pour l'Industrie Electronique (S.O.C.I.E.), Rosny-Sous-Bois, France

[21] Appl. No.: 342,230

[22] Filed: Apr. 21, 1989

[30] Foreign Application Priority Data

Apr. 22, 1988 [FR] France ..... 88 05368

[51] Int. Cl.[5] ..... H01R 13/04

[52] U.S. Cl. ..... 439/884

[58] Field of Search ..... 439/884–891

[56] References Cited

U.S. PATENT DOCUMENTS 4,090,772 1/1977 Goodman ..... 439/884

FOREIGN PATENT DOCUMENTS 0002083 5/1979 European Pat. Off. .

2450510 9/1980 France .

*Primary Examiner*—Neil Abrams

*Attorney, Agent, or Firm*—Schweitzer & Cornman

[57] ABSTRACT

The invention is a male contact element for low-insertion-force electrical connector of the type having a cylindrical pin portion prolonged at its extremity by a tapered portion terminating in a nose of constant-radius generatrices. The tapered portion has a length L such that $1.80d \leqq L \leqq 1.96d$, d being the nominal diameter of the cylindrical portion of the male contact element, and has a first ogival surface of revolution about the longitudinal axis of the contact with generatrices of constant radius, R such as $6.4d \leqq R \leqq 7.9d$, the first ogival surface connecting tangentially to the cylindrical portion, and a second ogival surface of revolution about the longitudinal axis of the contact constituting the nose of the contact of generatrices of constant radius r, having a value of $0.42d \leqq r \leqq 0.52d$, the first and second ogival surfaces connecting tangentially.

3 Claims, 1 Drawing Sheet

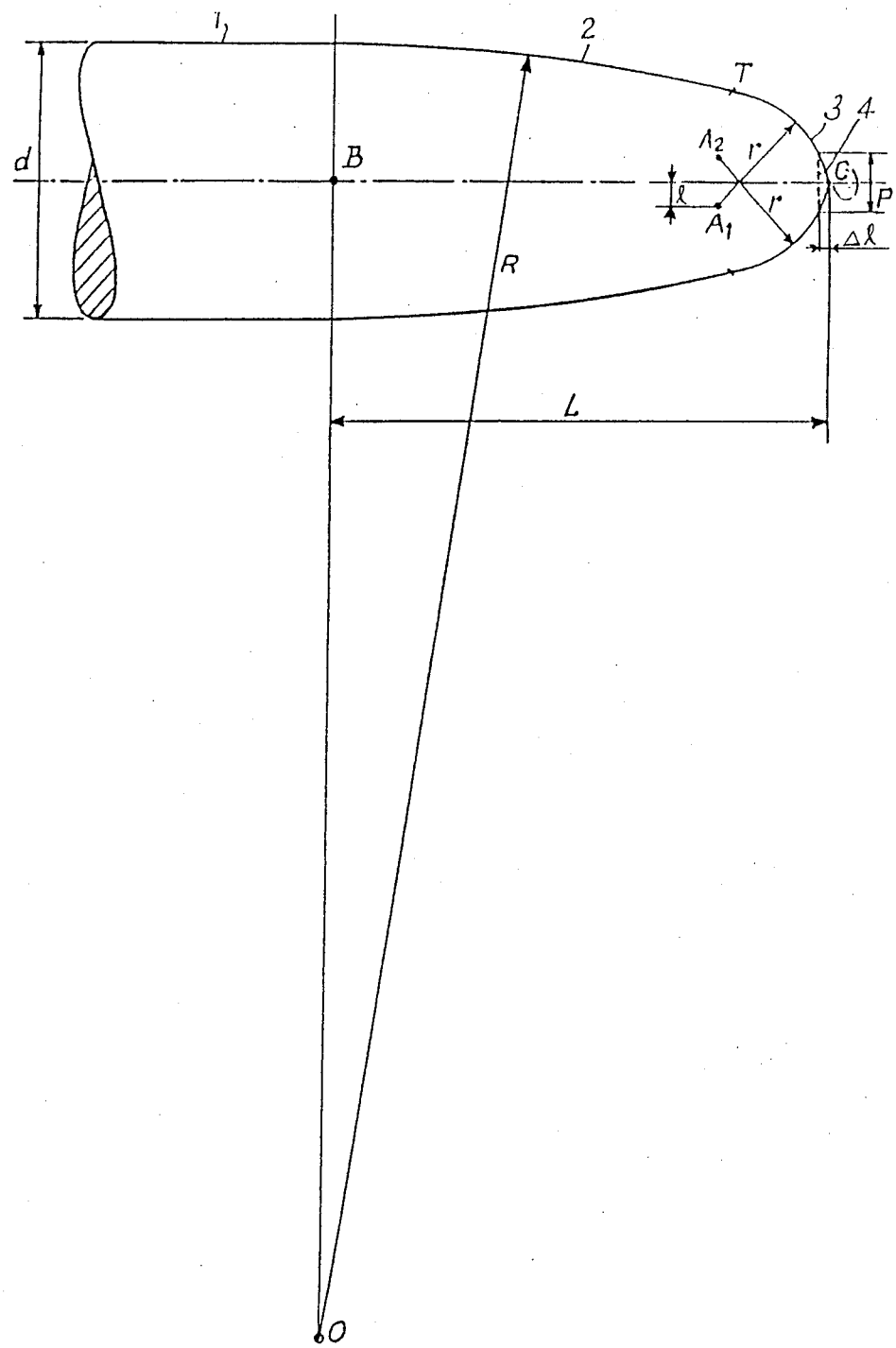
1
2
T
3
4
d
B
A2
r
G
P
ℓ
A1
r
Δℓ
R
L
O

MALE CONTACT ELEMENT FOR LOW INSERTION FORCE ELECTRICAL CONNECTOR

The present invention relates to a male contact element of low insertion force for an electrical connector, of the type having a cylindrical pin portion prolonged at its extremity by a tapered portion terminating in a nose having constant-radius generatrices.

In many fields, particularly in the field of aviation, multi-contact connectors are used which have an increasingly great number of contacts, some connectors having as much as several hundreds of contacts.

The force needed to couple together a male connecting element and a corresponding female connecting element increases with the number of contacts as a result of the multiplication of the individual insertion forces needed to engage each of the male contact elements in pin form in a corresponding female contact element in the form of a resilient socket.

Different shapes have been proposed for such male contact elements for the purpose of limiting the insertion force.

Examples of embodiments can be found in French patents No. 78 01597 (FR-A No. 2 378 379) and 79 05208 (FR-A No. 2 450 510).

In the first of these documents the tapered portion has a shape defined by surfaces of revolution generated about the longitudinal axis of the contact by ellipse equations.

In the second document cited, the tapered portion is truncoconical on most of its length, the rectilinear generatrices of the truncoconical portion being connected to those of the cylindrical portion by a circular portion.

Due to their structural characteristics, the male contact elements according to these prior documents all have a relatively great length in their tapered portion in proportion to the nominal diameter of the cylindrical portion of the contact, Such a length is incompatible with certain specifications and standards such as standard DOD-C-83527.

Moreover, the male contact elements according to the prior documents cited have a substantially hemispherical nose, all of the circular arc generatrices defining the nose having a common center on the longitudinal axis of the contact.

Experience shows that this condition is particularly difficult to create by the machining techniques in use.

The present invention proposes to create a contact element which, while having a shorter length in its tapered portion than that of the contact elements of the prior art, will be easy to machine and will have an insertion force of the same order if not less.

The contact element in accordance with the invention is characterized essentially by the fact that the tapered portion has a length L such that $1.80d \leqq L \leqq 1.96$ d, d being the nominal diameter of the cylindrical portion of the male contact element, and has a first ogival surface of revolution about the longitudinal axis of the contact with constant-radius generatrices R, such as $6.4d \leqq R \leqq$ to 7.9d, and a second ogival surface of revolution about the longitudinal axis of the contact, constituting the nose of the contact, having constant-radius generatrices r, having a value of $0.42d \leqq r \leqq 0.52d$, connecting tangentially, and the first ogival surface connecting tangentially the said cylindrical portion.

The terminal portion of the contact in accordance with the invention is thus constituted successively by a cylindrical portion and by two ogival portions of revolution, which permits simplified machining, particularly at the nose, to the extent that the center of each circular arc generatrix is offset from the longitudinal axis of the contact.

Advantageously, the amount of this offset is between about 0.08d and about 0.17d.

The geometric locus of the centers of the circular-arc generatrices of the ogival surface forming the nose is a circle of the radius o disposed in a plane orthogonal to the longitudinal axis of the contact.

Likewise, the geometric locus of the centers of the circular-arc generatrices of the ogival surface prolonging the cylindrical portion is a circle of the radius R situated in the frontal plane of the extremity of the cylindrical pin portion orthogonal to the longitudinal axis of the contact.

So as to facilitate machining, it is possible, according to a particular feature of the invention, to make the end of the contact element in the form of a planar surface orthogonal to the longitudinal axis of the contact, the diameter p of the said surface being such that $p \leqq 0.20d$. The length of the contact is then decreased by a length $\Delta 1 \leqq 0.06d$. The presence of this planar surface does not modify the operation of the contact to the extent that the initial thrust of the tapered part of the contact into the socket constituting the complementary contact element is performed in a zone situated at a distance considerably greater than $\Delta 1$ from the end of the contact.

An example of the embodiment of the invention is illustrated in the annexed drawing wherein the sole figure is a diagrammatic view of the end portion of a male contact element according to the invention.

The contact element according to the invention has at the end of its cylindrical pin portion 1 a tapered portion of length L constituted by two ogival surfaces of revolution about the longitudinal axis of contact 2 and 3, respectively, surface 3 defining the nose of the contact.

As it can be seen in the drawing, the ogival surface 3 is defined by circular arc generatrices of radius r, the generatrices illustrated being centered respectively at $A_1$ and $A_2$, points $A_1$ and $A_2$ being disposed symmetrically with respect to the longitudinal axis of the contact at a distance 1 from the latter.

The first ogival surface 2 which extends beyond the end plane, passing through point B of the cylindrical portion 1 of diameter d is defined by generatrices of radius R, the radius R illustrated in the drawing being centered on a point O situated in the plane orthogonal to the longitudinal axis of the contact and passing through the point B. Of course, all centers of the generatrices defining the ogival surface 2 are centered in this plane.

As it can be seen in the drawing, the generatrices of the ogival surface terminate at C at the level of the longitudinal axis of the contact, giving the nose a bullet-like shape. These generatrices connect tangentially at T with the generatrices defining the first ogival surface 2 of radius R.

A vertical plane surface 4 is illustrated in broken lines, which in a variant embodiment might constitute the end of the contact.

For the same nominal diameter d of the cylindrical portion, the male contact elements obtained in accordance with the invention have a length, as regards the tapered portion, that averages 20% less than the average length of the contacts made in accordance with the patents mentioned in the beginning, the insertion force measured for the same pins being substantially of the same order and even, in certain cases, on the order of 7% less.

The present invention can be embodied with all the known materials and used in present-day multiple contact connectors. Furthermore, the invention can be embodied with all of the appropriate machining techniques making it possible to obtain the surface conditions necessary for this type of application.

Although the invention has been described in connection with a particular embodiment, it is quite evident that it is by no means limited thereto, and that numerous variants and modifications can be made in it without thereby departing from its scope or its spirit.

I claim:

1. A male contact element for a low-insertion-force electrical connector of the type having an elongated cylindrical pin portion prolonged proximate its extremity by a tapered portion terminating in a nose of constant-radius generatrices, said contact element characterized in that (a) the tapered portion has a length L of $1.80d \leqq L \leqq 1.96d$, d being the nominal diameter of the cylindrical pin portion of the male contact element;

(b) the tapered portion has a first ogival surface of revolution about the longitudinal axis of the contact element with generatrices of constant radius R, such as $6.4d \leqq R \leqq 7.9d$;

(c) a first ogival surface connects tangentially to the cylindrical portion;

(d) a second ogival surface of revolution about the longitudinal axis of the contact element, said second ogival surface constituting said nose of the contact and having generatrices of constant radius r, in which $0.42d \leqq r \leqq 0.52d$; and (e) the first and second ogival surfaces being tangentially connected.

2. A male contact element in accordance with claims 1, further characterized in that:

(a) the center $(A_1,A_2)$ of the circular arc generatrices of the said second ogival surface is offset from the longitudinal axis of the contact element by a value 1, equal to approximately 0.08 to 0.17d.

3. A male contact element for a low-insertion-force electrical connector of the type having an elongated cylindrical pin portion prolonged proximate its extremity by a tapered portion terminating in a nose of constant-radius generatrices, said contact element characterized in that (a) the tapered portion has a length L of $1.80d \leqq L \leqq 1.96d$, d being the nominal diameter of the cylindrical portion of the male contact element;

(b) the tapered portion has a first ogival surface of revolution about the longitudinal axis of the contact element with generatrices of constant radius R, such as $6.4d \leqq R \leqq 7.9d$;

(c) a first ogival surface connecting tangentially to the cylindrical portion;

(d) a second ogival surface of revolution about the longitudinal axis of the contact element, said second ogival surface constituting said nose of the contact and having generatrices of constant radius r, in which $0.42d \leqq r \leqq 0.52d$;

(e) the first and second ogival surfaces are tangentially connected;

(f) the center $(A_1,A_2)$ of the circular arc generatrices of the second ogival surface is offset from the longitudinal axis of the contact element by a value 1, equal to approximately 0.08 to 0.17d; and (g) the nose of said contact is in the form of a planar surface orthogonal to the longitudinal axis of the contact, the diameter p of said planar surface being of a value $p \leqq 0.20d$.

* * * * *